US012458106B2

(12) United States Patent
Engel et al.

(10) Patent No.: US 12,458,106 B2
(45) Date of Patent: Nov. 4, 2025

(54) ARTICLE OF FOOTWEAR INCLUDING A SOLE STRUCTURE

(71) Applicant: Converse Inc., Boston, MA (US)

(72) Inventors: Gavin D. Engel, Boston, MA (US); ZhiQiang Li, Andover, MA (US); Daniel J. Martin, Boston, MA (US); Jun Ming Huang, Foshan (CN); Chao Bi Xian, Boston, MA (US); Guoping Zhao, Zhongshan (CN)

(73) Assignee: Converse Inc., Boston, MA (US)

( * ) Notice: Subject to any disclaimer, the term of this patent is extended or adjusted under 35 U.S.C. 154(b) by 0 days.

(21) Appl. No.: 18/630,645

(22) Filed: Apr. 9, 2024

(65) Prior Publication Data

US 2024/0335004 A1 Oct. 10, 2024

Related U.S. Application Data

(60) Provisional application No. 63/495,233, filed on Apr. 10, 2023.

(51) Int. Cl.
*A43B 13/36* (2006.01)
*A43B 13/12* (2006.01)

(52) U.S. Cl.
CPC ..... *A43B 13/36* (2013.01); *A43B 13/122* (2013.01); *A43B 13/125* (2013.01)

(58) Field of Classification Search
CPC ..... A43B 13/36; A43B 13/122; A43B 13/125; A43B 3/246
USPC ..... 36/15
See application file for complete search history.

(56) References Cited

U.S. PATENT DOCUMENTS 4,062,132 A * 12/1977 Klimaszewski ..... A43B 3/24 36/100
5,083,385 A * 1/1992 Halford ..... A43B 13/36 36/100
5,533,280 A 7/1996 Halliday
7,246,453 B2 7/2007 Kim
7,984,569 B2 7/2011 Chaney et al.
8,307,571 B1 11/2012 Ceylan
8,544,189 B2 * 10/2013 Chaney ..... A43B 13/24 36/15
9,756,897 B1 9/2017 Millis
9,974,353 B2 5/2018 Mulholland
(Continued)

FOREIGN PATENT DOCUMENTS

EP 0153136 A2 8/1985
FR 2869767 B1 11/2005
(Continued)

OTHER PUBLICATIONS

International Search Report and Written Opinion, PCT App. No. PCT/US2024/023724, mailed Jul. 10, 2024. (11 pages.).

*Primary Examiner* — Ted Kavanaugh
(74) *Attorney, Agent, or Firm* — Bookoff McAndrews, PLLC

(57) ABSTRACT

A sole structure for an article of footwear having a midsole having a support surface extending from a posterior end to an anterior end, the midsole having an outer surface and an inner surface, wherein the support surface and the inner surface surround a cavity, the midsole also including an inner rail extending along the inner surface and into the cavity, wherein the rail and the cavity are configured to engage with a removable outsole.

20 Claims, 13 Drawing Sheets

(56) References Cited

U.S. PATENT DOCUMENTS

| | | | | |
|---|---|---|---|---|
| 10,104,936 | B2 | 10/2018 | Mulholland | |
| 10,226,102 | B2 | 3/2019 | Santos et al. | |
| 11,350,698 | B2 | 6/2022 | Fogarty et al. | |
| 2006/0130364 | A1* | 6/2006 | Greene | A43B 7/28 36/15 |
| 2008/0222920 | A1 | 9/2008 | Rovida | |
| 2014/0109440 | A1 | 4/2014 | Mcdowell et al. | |
| 2018/0153255 | A1 | 6/2018 | Coleman | |
| 2018/0206596 | A1 | 7/2018 | Yang | |
| 2021/0274884 | A1* | 9/2021 | Constant | A43B 13/04 |

FOREIGN PATENT DOCUMENTS

| | | | |
|---|---|---|---|
| GB | 2517189 | A | 2/2015 |
| KR | 200170955 | Y1 | 6/2000 |
| KR | 101335357 | B1 | 12/2013 |
| KR | 20190048031 | A | 5/2019 |
| WO | 2006031005 | A1 | 3/2006 |
| WO | 2013038034 | A1 | 3/2013 |

* cited by examiner

ARTICLE OF FOOTWEAR INCLUDING A SOLE STRUCTURE

CROSS-REFERENCE TO RELATED APPLICATION(S)

This application claims priority to U.S. Provisional Application No. 63/495,233, filed Apr. 10, 2023, the entirety of which is incorporated herein by reference.

FIELD

The present disclosure relates generally to articles of footwear including sole structures, and more particularly, to sole structures incorporating interchangeable outsoles.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. An insole may be located within the upper and adjacent to a plantar (i.e., lower) surface of the foot to enhance footwear comfort, and is typically a thin, compressible member.

BRIEF DESCRIPTION OF THE DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
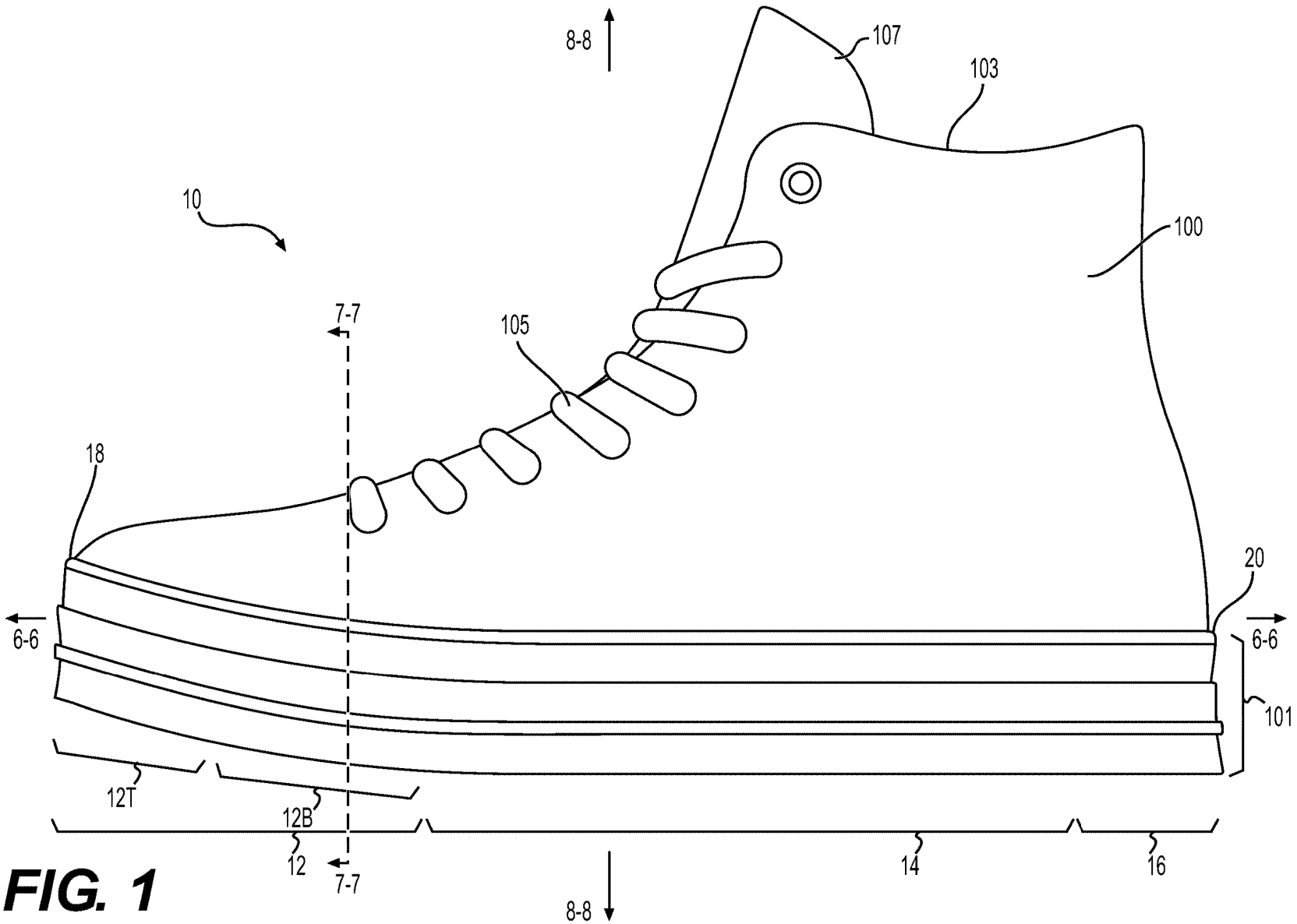
FIG. 1 is a side view of an article of footwear.

Example configurations will now be described more fully with reference to the accompanying drawings. Example configurations are provided so that this disclosure will be thorough and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer, or section. Terms such as "first," "second," and other numerical terms do not imply a sequence or order unless clearly indicated by the context. Thus, a first element, component, region, layer, or section discussed below could be termed a second element, component, region, layer, or section without departing from the teachings of the example configurations. In the discussion that follows, terms "about,"

"approximately," "substantially," and the like, when used in describing a numerical value, denote a variation of +/−10% of that value, unless specified otherwise.

When an element or layer includes a directional and/or spatial term (e.g., top, bottom, medial, lateral, etc.), the directional and/or spatial term is used relative to a user's foot anatomy when the article of footwear is being worn by a user. The user is considered to be standing on a flat, level surface.

The subject matter of embodiments of the present disclosure is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly stated.

Articles of footwear include different types of shoes, sandals, boots, heels, or the like. For the sake of clarity, articles of footwear will be discussed herein as shoes; however, embodiments are not limited solely to shoes. The technology disclosed herein may equally be used to create footwear other than shoes. To alleviate confusion and to provide a more readable disclosure, embodiments simply reference shoes. To that end and to provide a robust disclosure, different component portions of shoes are discussed herein, including uppers, midsoles, and outsoles. One skilled in the art will understand that shoes may include an upper and a sole structure, with the latter comprising an outsole, a midsole, and perhaps an insole.

The present disclosure is directed to an article of footwear, such as an article of footwear 10 shown in FIG. 1, that provides underfoot cushioning and responsiveness during use. FIG. 1 depicts an article of footwear 10 that further provides a balance of comfort and stability. Additionally, the article of footwear 10 is selectively customizable and modular such that a user of the article of footwear 10 may attach, add, join, remove, replace, and/or swap out different outsoles of the footwear 10 to accommodate various characteristics, functionalities, aesthetics, designs, or other features to the footwear 10. The user would also be able to replace the outsole after normal wear and tear during the life of the article of footwear 10. As described herein, the footwear 10 is configured and operable to facilitate a selective connection with one or more outsoles without the use of external equipment, tools, or other ancillary devices.

As shown in FIG. 1, footwear 10 includes a sole structure 101 and an upper 100 attached to the sole structure 101. The article of footwear 10 is divided into a forefoot region 12, a mid-foot region 14, and a heel region 16. The forefoot region 12 includes a toe portion 12T corresponding to the phalanges of the foot, and a ball portion 12B corresponding to a metatarsophalangeal (MTP) joint. The mid-foot region 14 corresponds with an arch area of the foot, and the heel region 16 corresponds with rear portions of the foot, including a calcaneus bone. The footwear 10 further includes an anterior end 18 including a forward-most point of the forefoot region 12, and a posterior end 20 including a rearward-most point of the heel region 16. For ease of discussion, the footwear 10 is discussed with reference to a longitudinal axis 6-6, a medial-lateral axis AML (shown in FIG. 7A), and a vertical axis 8-8, where the longitudinal axis 6-6, the medial-lateral axis AML, and the vertical axis 8-8 are perpendicular to each other. The longitudinal axis 6-6 of the footwear 10 extends along a length of the footwear 10 from the anterior end 18 to the posterior end 20, and generally divides the footwear 10 into a medial side 22 and a lateral side 24 (shown in FIG. 7A). The medial-lateral axis AML extends from medial side 22 to lateral side 24. Accordingly, the medial side 22 and the lateral side 24 respectively correspond with opposite sides of the footwear 10 and extend from the anterior end 18 to the posterior end 20. The vertical axis 8-8 extends from a bottom (i.e., ground-contacting portion) of the footwear 10 to a top of the footwear 10.

Still referring to FIG. 1, the upper 100 includes interior surfaces that define an interior void configured to receive and secure a foot for support on sole structure 101. The upper 100 may be formed from one or more materials that are stitched, adhesively bonded, or otherwise joined together to form the interior void. Suitable materials of the upper 100 may include, but are not limited to, mesh, textiles, foam, leather, and synthetic leather. The materials are configured and located to impart properties of durability, air-permeability, wear-resistance, flexibility, and/or comfort.

In some examples, the upper 100 includes a strobel (not shown) having a bottom surface opposing the sole structure 101, and an opposing top surface defining a footbed of the interior void. Stitching or adhesives secure the strobel to the upper 100. The footbed is contoured to conform to a profile of the bottom surface (e.g., plantar) of the foot. Optionally, the upper 100 may incorporate additional layers such as an insole or sockliner (not shown) that are disposed on the strobel and reside within the interior void of the upper 100 to receive a plantar surface of the foot to enhance the comfort of the article of footwear 10. An ankle opening 103 in the heel region 16 provides access to the interior void. For example, the ankle opening 103 receives a foot to secure the foot within the void and facilitates entry and removal of the foot from and to the interior void. In some examples, one or more fasteners 105 extend along the upper 100 to adjust a fit of the interior void around the foot, and to accommodate entry and removal of the foot therefrom. The fasteners 105 may include laces, straps, cords, hook-and-loop, or any other suitable type of fastener. The upper 100 can include a tongue portion 107 that extends between the interior void and the fasteners.

Figure 2:
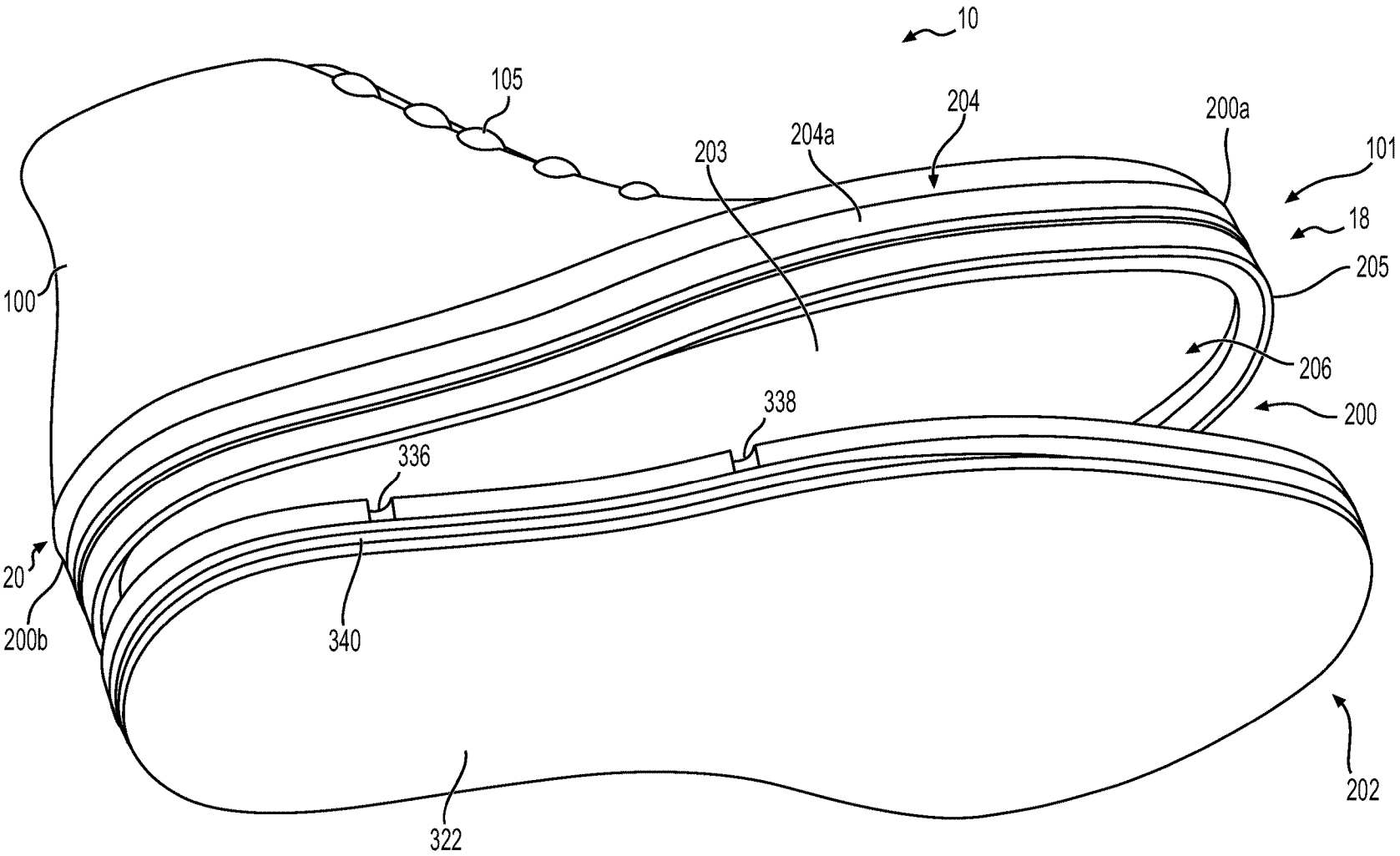
FIG. 2 is an exploded perspective view of a sole structure of the article of footwear of FIG. 1.

Referring to FIG. 2, the sole structure 101 includes a midsole 200 and an outsole 202. The midsole 200 is coupled to the upper 100, and the outsole 202 is removably coupled to the midsole 200, as described herein. The midsole 200 includes a rand 204 and a cavity 206. The midsole 200 extends from an anterior end 200*a* disposed in the forefoot region 12 to a posterior end 200*b* disposed in the heel region 16. The midsole 200 includes a first, upper surface 201 (shown in FIG. 4), a second, lower surface 203 opposite the first surface 201, and a third surface 205 opposite the first surface 201 and offset from the second surface 203 (e.g., in a direction parallel to the vertical axis 8-8 of FIG. 1). The first surface 201 is disposed adjacent to, and faces, the upper 100 relative to the second surface 203. The second surface 203 is disposed adjacent to, and faces, a ground surface, or an otherwise ground contacting portion when the footwear 10 is fully assembled, relative to the first surface 201. The third surface 205 extends outwardly (e.g., downward) from the second surface 203 and faces the ground surface, such that the third surface 205 is disposed adjacent to the ground surface relative to the second surface 203.

Figure 3B:
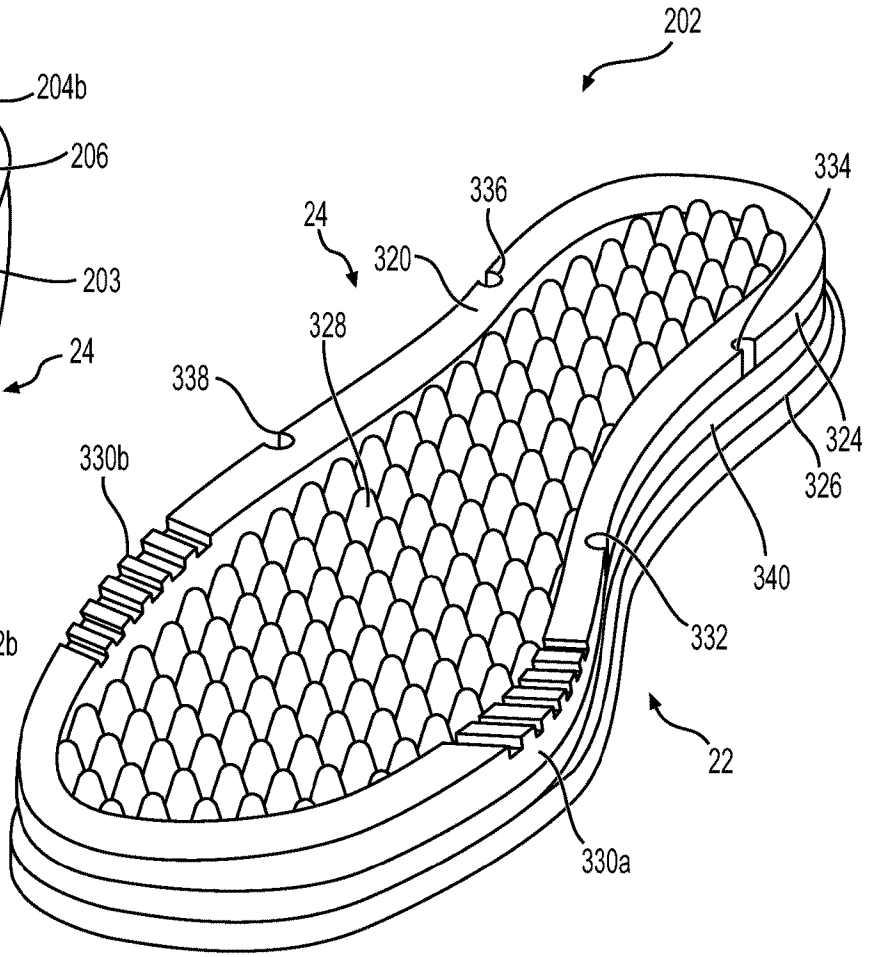
FIG. 3B is a top perspective view of an outsole of the article of footwear of FIG. 1.
Figure 3A:
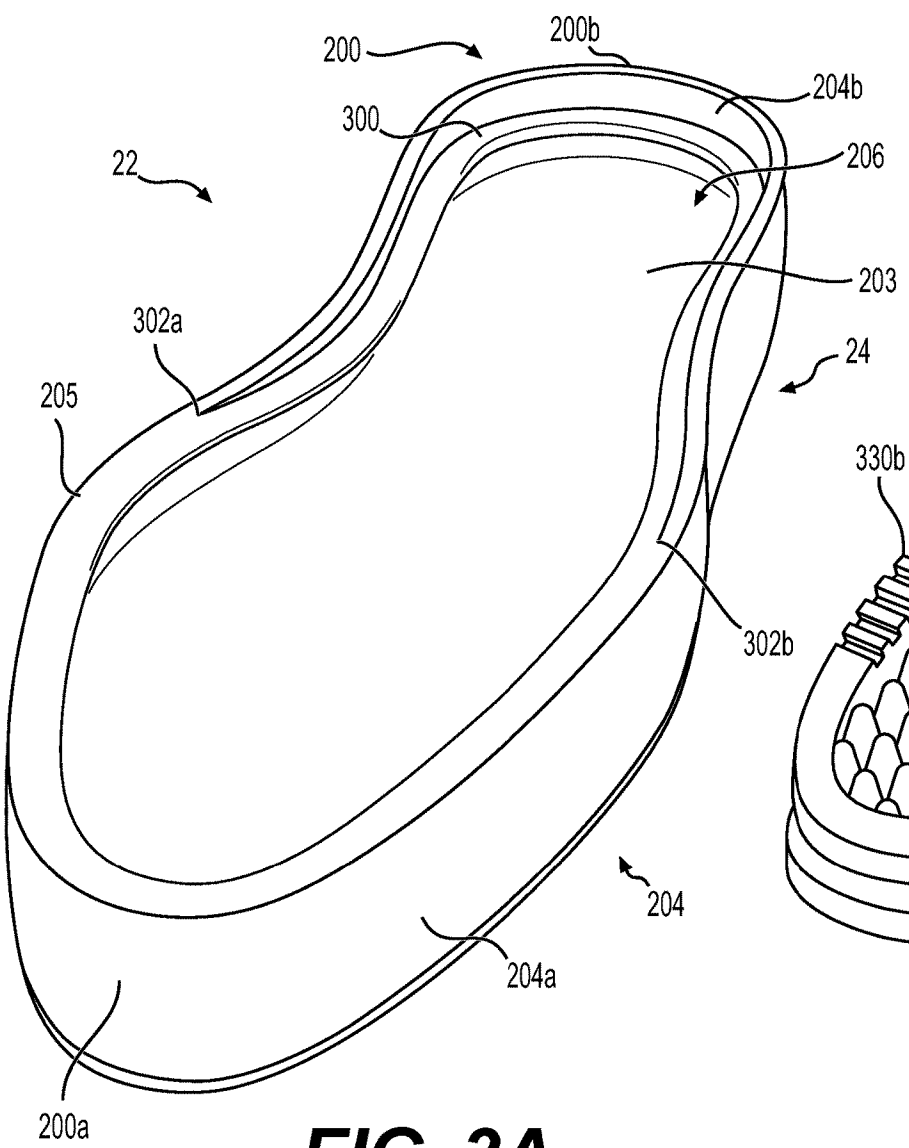
FIG. 3A is a bottom perspective view of a midsole of the article of footwear of FIG. 1.

The rand 204 includes a radial outer surface 204*a* and a radial inner surface 204*b* (shown in FIG. 3A). The outer surface 204*a* of the rand 204 forms an outer surface of the midsole 200. The inner surface 204*b* of the rand 204 forms a portion of a boundary of the cavity 206. The outer surface 204*a* and the inner surface 204*b* extend continuously about a circumference of the sole structure 101. The second surface 203 is configured to define a support surface of the midsole 200. The second surface 203 forms a portion of a boundary of the cavity 206. The cavity 206 is disposed opposite the upper 100 and faces the ground surface or an otherwise ground contacting portion when the footwear 10 is fully assembled. The cavity 206 of the midsole 200 is configured to removably receive the outsole 202, such that the outsole 202 may be selectively removable from the midsole 200, as will be described in further detail below. That is, outsole 202 is positioned within the article of footwear 10 in such a way that outsole 202 may be removed from the article of footwear 10 and replaced by, for example, another outsole.

Referring to FIG. 3A, the midsole 200 includes a rail (inner rail) 300 extending inwards towards the cavity 206 from the inner surface 204*b* of the rand 204. For clarity purposes, midsole 200 is shown facing upwards and away from a ground surface to clearly depict internal elements of the midsole 200 described herein, while said internal elements are described in relation with the midsole 200 facing a ground surface. The rail 300 extends continuously about a circumference of the cavity 206 and along the inner surface 204*b*. The rail 300 extends from the posterior end 200*b* of the midsole 200 to the anterior end 200*a* of the midsole 200.

At the posterior end 200*b*, portions of the inner surface 204*b* are positioned above and below the rail 300. The rail 300 extends from the posterior end 200*b* to each of the transition regions 302*a* and 302*b* until a portion of the inner surface 204*b* extends only above the rail 300, such as between the rail 300 and the second surface 203. In other words, the transition regions 302*a*, 302*b* are positioned along the third surface 205, and the rail 300 extends along the inner surface 204*b* and towards the transition regions 302*a*, 302*b* until the rail 300 is flush with the third surface 205 at or adjacent to the transition regions 302*a*, 302*b*. In some embodiments, a combination of the rail 300 and the third surface 205 extends from the transition regions 302*a* and 302*b* towards the anterior end 200*a* such that the inner surface 204*b* continues to extend only above the rail 300 (i.e., between the rail 300 and the second surface 203) along the forefoot region 12.

Still referring to FIG. 3A, from the transition regions 302*a* and 302*b* to the anterior end 200*a*, the rail 300 becomes flush with the third surface 205 such that the combination of the rail 300 and the third surface 205 define a lowest portion (and greatest height) of the midsole 200 nearest the anterior end 200*a*. From the transition regions 302*a* and 302*b* towards the anterior end 200*a* (i.e., along the forefoot region 12), the rail 300 slopes upward (e.g., away from the ground surface or otherwise ground contacting portion of the footwear 10 when fully assembled) after sloping downward from the posterior end 200*b* to the transition regions 302*a* and 302*b* (e.g., towards from the ground surface or otherwise ground contacting portion of the footwear 10 when fully assembled). The lowest portion of the midsole 200 is a portion furthest away from the upper 100. In other words, rail 300 may be angled and/or have a ramped configuration from the anterior end 200*a* to the posterior end 200*b*. The rail 300 may be configured to facilitate selective removal of the outsole 202 from the midsole 200, as described further herein.

Referring to FIG. 3B, the outsole 202 includes a first, top surface 320, a second, bottom surface 322 (shown in FIG. 2), a third, sidewall (or outer) surface 324, and a flange 326. The first surface 320 is a surface of the outsole 202 facing the upper 100. The second surface 322 is a ground-facing surface of the outsole 202. The first surface 320 may include one or more (e.g., a plurality) engagement features 328 as well as one or more slits 330*a* and 330*b*. The engagement feature(s) 328 may define a cored portion of the outsole 202. In an example, the engagement feature(s) 328 may include a plurality of protrusions, abutments, tabs, and/or other suitable structure defining a series of peaks and valleys across the cored portion. In one example, the cored portion may include recesses between respective peaks of the engagement feature(s) 328. The engagement feature(s) 328 are used when the outsole 202 is a thermoplastic polyurethane (TPU), thermoplastic elastomer (TPE), or the like. The engagement feature(s) 328 may provide a feeling of sensation, traction, or comfort to a user of the article of footwear 10.

The one or more slits 330*a* and 330*b* may be disposed near an anterior end 200*a* of the outsole 202. The first surface 320 includes a first vertical cut 332, a second vertical cut 334, a third vertical cut 336, and a fourth vertical cut 338. Each of the vertical cuts 332, 334, 336, and 338 are a portion of the outsole 202 where material has been removed from the first surface 320. Each of the vertical cuts 332, 334, 336, and 338 may be configured to reduce horizontal forces imparted on the article of footwear 10 during use by a user. The first surface 320 may include one, two, three, four, or more vertical cuts as desired to reduce the horizontal forces imparted on the article of footwear 10. Vertical cuts 332 and 334 are disposed on the medial side 22 of the outsole 202. Vertical cuts 336 and 338 are disposed on the lateral side 24 of the outsole 202. The one or more slits 330*a* and 330*b* may be configured to increase flexure (e.g., enhance a flexibility) of the article of footwear 10, such as along the anterior region 200*a*. There may be one, two, three, four, five, six, or more slits as desired to increase flexure of the article of footwear 10.

Still referring to FIG. 3B, the sidewall 324 extends circumferentially around the periphery of the outsole 202. The sidewall 324 is recessed relative to an exterior surface of the flange 326, such that the flange defines an outermost boundary of the outsole 202 that is outwardly offset from the sidewall 324. The sidewall 324 extends vertically (e.g., in a direction parallel to the vertical axis 8-8 of FIG. 1) between the flange 326 and the first surface 320. The sidewall 324 includes a recess 340 that extends circumferentially around the sidewall 324. The recess 340 is sized, shaped, and/or otherwise configured to receive a corresponding portion (e.g., the rail 300) of the midsole 200 to selectively couple the outsole 202 to the midsole 200.

Each of the vertical cuts 332, 334, 336, and 338 may extend vertically downward (e.g., in a direction parallel to the vertical axis 8-8 of FIG. 1) from the first surface 320, through a first sidewall portion 324*a* (shown in FIG. 6), and towards the recess 340. As described herein, the vertical cuts 332, 334, 336, and 338 may be sized, shaped, and/or otherwise configured to mate with a corresponding feature or portion of the midsole 200 to selectively couple the outsole 202 to the midsole 200. Although four vertical cuts 332, 334, 336, and 338 are shown and described herein, it should be appreciated that additional and/or fewer vertical cuts may be included in the outsole 202 without departing from a scope of this disclosure. For example, in an embodiment, the outsole 202 may include any corresponding number of vertical cuts necessary for mating the outsole 202 with the midsole 200.

Figure 4:
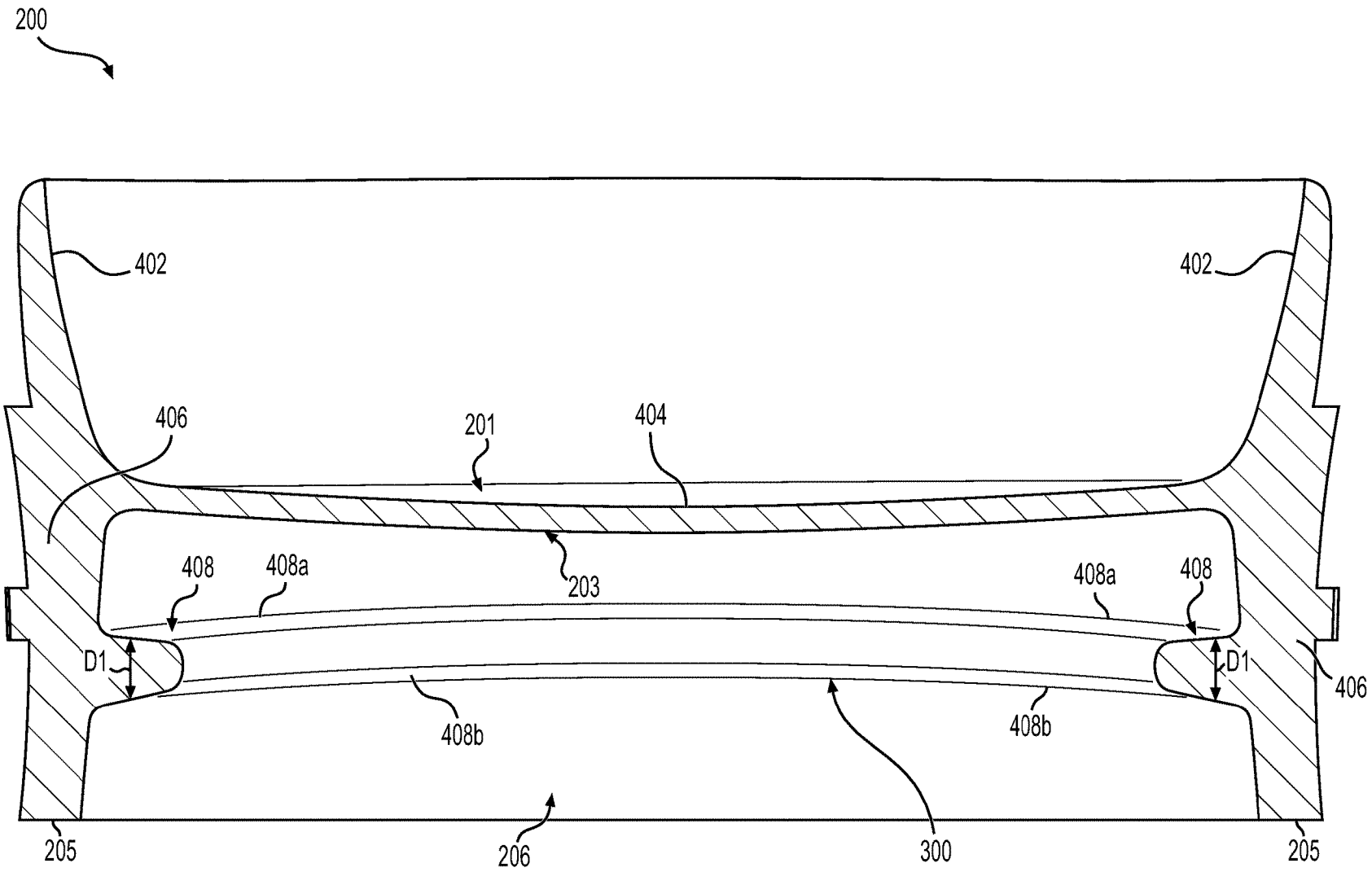
FIG. 4 is a cross-sectional view of the midsole of the article of footwear of FIG. 1.

Referring now to FIG. 4, the midsole 200 may include a generally H-shaped cross-section. In particular, the midsole 200 includes a top portion 402 extending around and attached to the upper 100 by various suitable means (e.g., via an adhesive, a glue, a stitching, or the like.) The midsole 200 further includes a crossbar portion 404 formed of a thin layer of material that is attached to a foot receiving surface of the footwear 10. In an exemplary embodiment, the crossbar portion 404 is attached to a strobel (not shown) of the upper 100. The thin layer of material of the crossbar portion 404 may include, for example, rubber. A first, upper portion 404*a* (shown in FIG. 7A) of the crossbar portion 404 is attached to the upper 100. A second, lower portion 404*b* (shown in FIG. 7A) of the crossbar portion 404 faces the outsole 202. The crossbar portion 404 may be cupped or otherwise have a curved (e.g., non-planar) profile. The midsole 200 includes a bottom portion 406 with the rail 300 positioned thereon.

The rail 300 includes a flange 408. The flange 408 includes a distance D1 (e.g., a height) that generally extends vertically (e.g., parallel to the vertical axis 8-8 of FIG. 1). The distance D1 is a distance from a top edge 408*a* to a bottom edge 408*b* of the flange 408. The flange 408 extends laterally inward and into the cavity 206. In the example, the flange 408 has a generally rounded shape. In other examples, the flange 408 may have various other suitable shapes or sizes. The flange 408 forms an upward bias for the rail 300. In other words, the flange 408 of the rail 300 is disposed such that the rail 300 has a bias towards the upper 100. Rail 300 is angled, and extends in a way such that it is configured to bias the outsole 202 towards the upper 100, when fully assembled. The rail 300 may be configured to elastically deform and return to its starting state so that a pulling force is applied to the rail 300, such as during removal of the outsole 202 from the midsole 200 as described in detail herein.

Figure 5A:
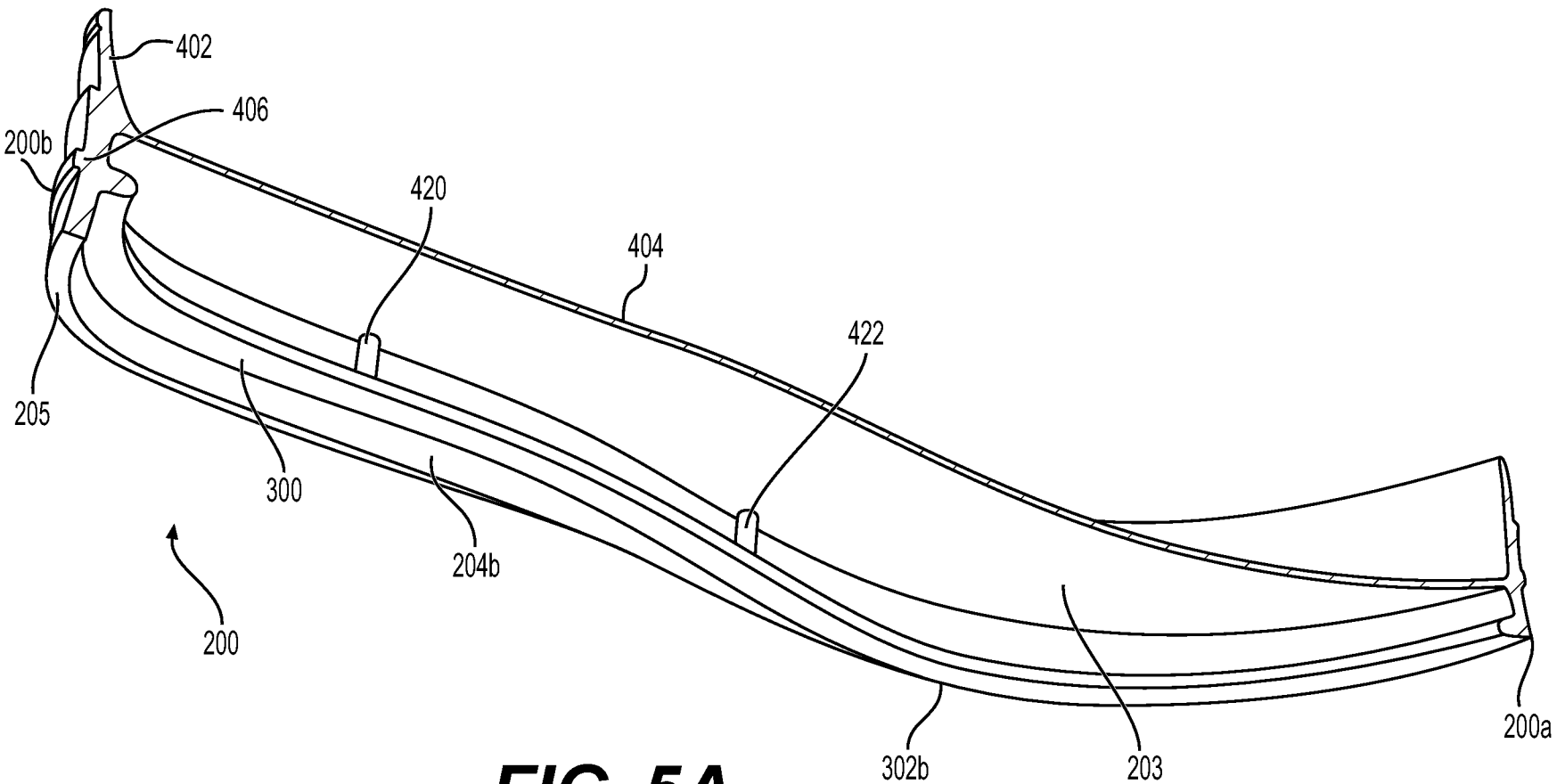
FIG. 5A is a perspective cross-sectional view of the midsole of FIG. 3A.

Referring to FIG. 5A, the midsole 200 includes a first vertical protrusion 420 and a second vertical protrusion 422. The first vertical protrusion 420 and the second vertical protrusion 422 each extend from the rail 300 to the second surface 203 of the midsole 200. The first vertical protrusion 420 is disposed adjacent to the posterior end 200*b* relative to the second vertical protrusion 422. The first vertical protrusion 420 and the second vertical protrusion 422 are disposed on the medial side 22 of the midsole 200. As described herein, vertical protrusions 420, 422 may be configured to mate with a corresponding feature or portion of the outsole 202 to selectively couple the midsole 200 to the outsole 202.

For clarity purposes, only two vertical protrusions are shown, but vertical protrusions may be disposed on both the medial side 22 and the lateral side 24 of the midsole 200. Although two vertical protrusions are shown and described herein, it should be appreciated that additional and/or fewer protrusions may be included in the midsole 200 without departing from a scope of this disclosure. For example, in an embodiment, the midsole 200 may include any number of vertical protrusions necessary for mating the midsole 200 with the outsole 202.

Figure 5B:
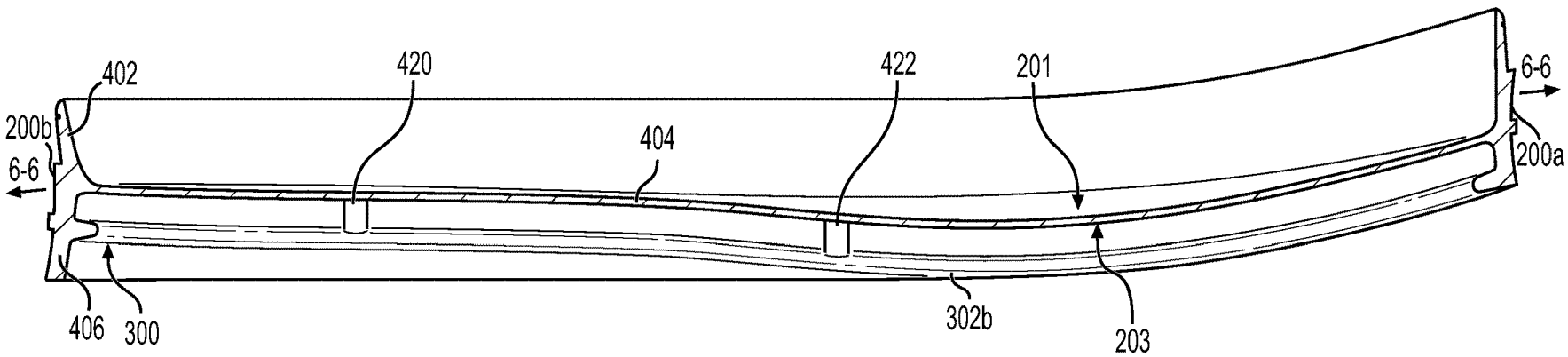
FIG. 5B is a side cross-sectional view of the midsole of FIG. 3A.

FIG. 5B shows a medial cross-sectional view of the midsole 200. From the anterior end 200*a* to the posterior end 200*b*, the rail 300 has a varying configuration and/or slope along a longitudinal length of the midsole 200 (e.g., relative to the horizontal axis 6-6). The rail 300 slopes downward (e.g., towards the ground surface) along the inner surface 204*b* from the posterior end 200*b* to a first transition region 302*a* on the medial side 22 and a second transition region 302*b* on the lateral side 24. For example, the rail 300 slopes gradually downward towards the ground surface and/or relative to the horizontal axis 6-6 from the posterior end 200*b* to the transition region 302*b* in the mid-foot region 14 of the footwear 10. From the transition region 302*b* to the anterior end 200*a*, the rail 300 slopes upward away from the ground surface and/or relative to the horizontal axis 6-6.

Figure 5C:
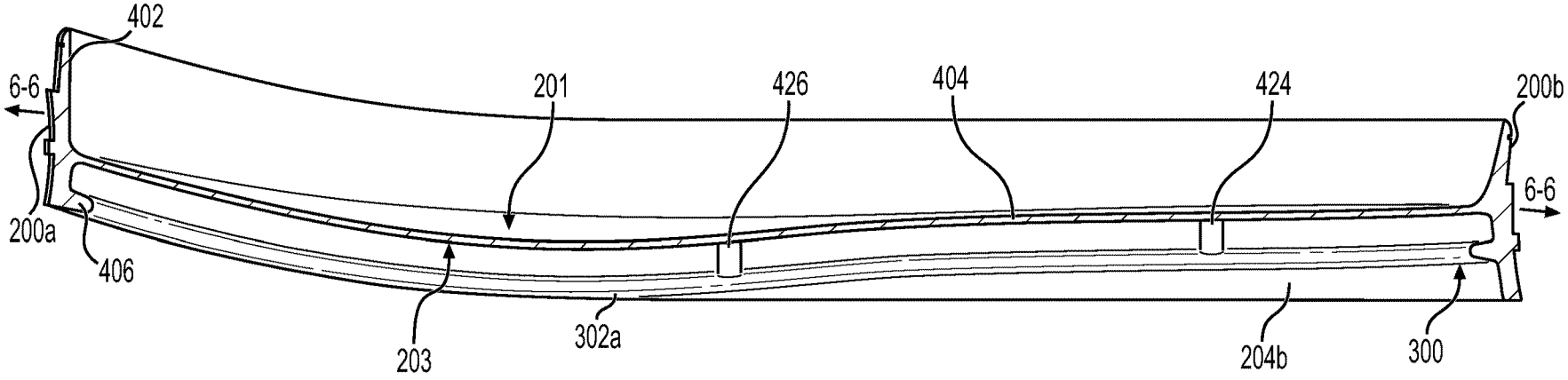
FIG. 5C is a side cross-sectional view of the midsole of FIG. 3A.

FIG. 5C shows a lateral cross-sectional view of the midsole 200. As described above with respect to FIG. 5C, from the anterior end 200*a* to the posterior end 200*b*, the rail 300 has a varying configuration and/or slope relative to the horizontal axis 6-6. The rail 300 slopes gradually downward relative to the horizontal axis 6-6 from the posterior end 200*b* to the transition region 302*a* in the mid-foot region 14 of the footwear 10. From the transition region 302*a* to the anterior end 200*a*, the rail 300 slopes upward relative to the horizontal axis 6-6. The midsole 200 includes a third vertical protrusion 424 and a fourth vertical protrusion 426, each of which extend from the rail 300 to the second surface 203 of the midsole 200. The third vertical protrusion 424 is disposed adjacent to the posterior end 200*b* relative to the fourth vertical protrusion 426. The third vertical protrusion 424 and the fourth vertical protrusion 426 are disposed on the lateral side 24 of the midsole 200, and may be substantially similar to first vertical protrusion 420 and second vertical protrusion 422.

Each of the vertical protrusions 420, 422, 424, and 426 (see FIGS. 5A-5B) may include similar cross-sectional profiles (e.g., height, shape, width, depth, etc.). For example, one of the third vertical protrusion 424 or fourth vertical protrusion 426 may include the same dimension as the first vertical protrusion 420 and second vertical protrusion 422, while another of third vertical protrusion 424 or fourth vertical protrusion 426 may include a different dimension from the first vertical protrusion 420 and second vertical protrusion 422. In another example, each of the vertical protrusions 420, 422, 424, and 426 may include the same dimension.

Figure 6:
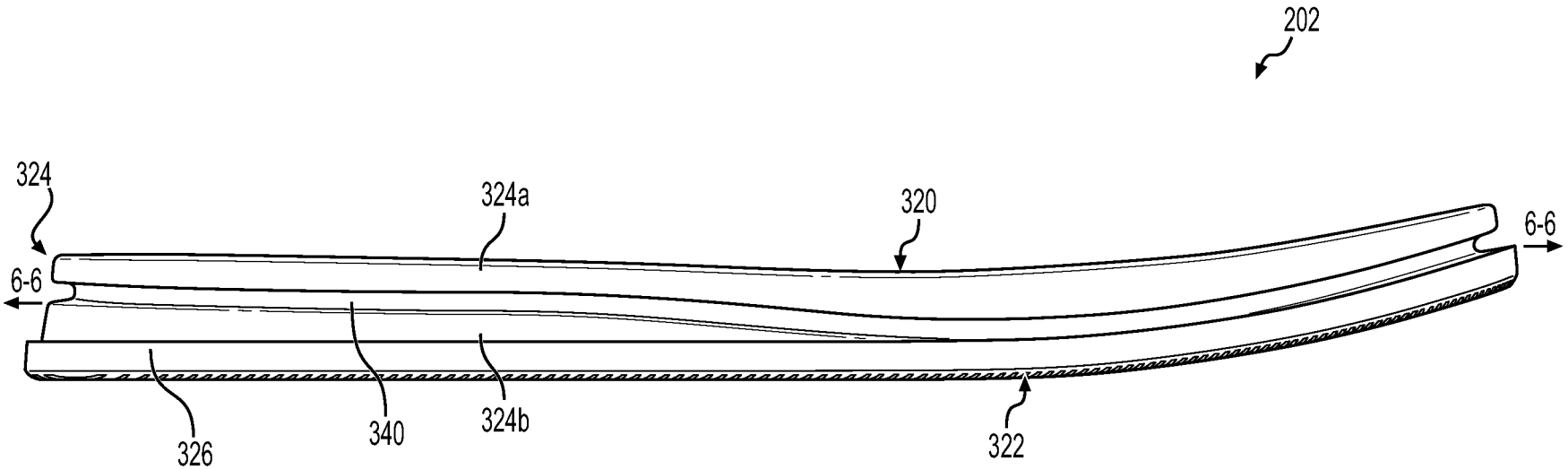
FIG. 6 is a side view of the outsole of the article of footwear of FIG. 1.

FIG. 6 shows a side view of the outsole 202 in isolation from the upper 100 and the midsole 200. The recess 340 slopes downward relative to the horizontal axis 6-6 from the heel region 16 to the mid-foot region 14. The recess 340 slopes upward from the mid-foot region 14 to the forefoot region 12. The recess 340 divides the sidewall 324 into a first, upper sidewall portion 324*a* and a second, lower sidewall portion 324*b*. The first sidewall portion 324*a* extends in the posterior-anterior direction (parallel to the horizontal axis 6-6) from the anterior end 200*a* to the posterior end 200*b*. The second sidewall portion 324*b* extends in the posterior-anterior direction (parallel to the horizontal axis 6-6) from the posterior end 200*b* to an area along the sidewall 324 proximal to the anterior end 200*a*. In other words, the first sidewall portion 324*a* has a greater longitudinal length (along the horizontal axis 6-6) than the second sidewall portion 324*b*. The second sidewall portion 324*b* becomes flush with the flange 326 proximal to the anterior end 200*a*. The flange 326 extends around an outer periphery of the outsole 202. The flange 326 bounds a bottom area of the recess 340 in the forefoot region 12, and a bottom area of the second sidewall portion 324*b* in the mid-foot region 14 and heel region 16. The recess 340 may be ramped such that an anterior portion of the recess 340, positioned adjacent to the anterior end 200*a*, is disposed proximate to a ground surface relative to a posterior portion of the recess 340, positioned adjacent to the posterior end 200*b*, when the first surface 320 is disposed facing the upper 100.

Figure 7A:
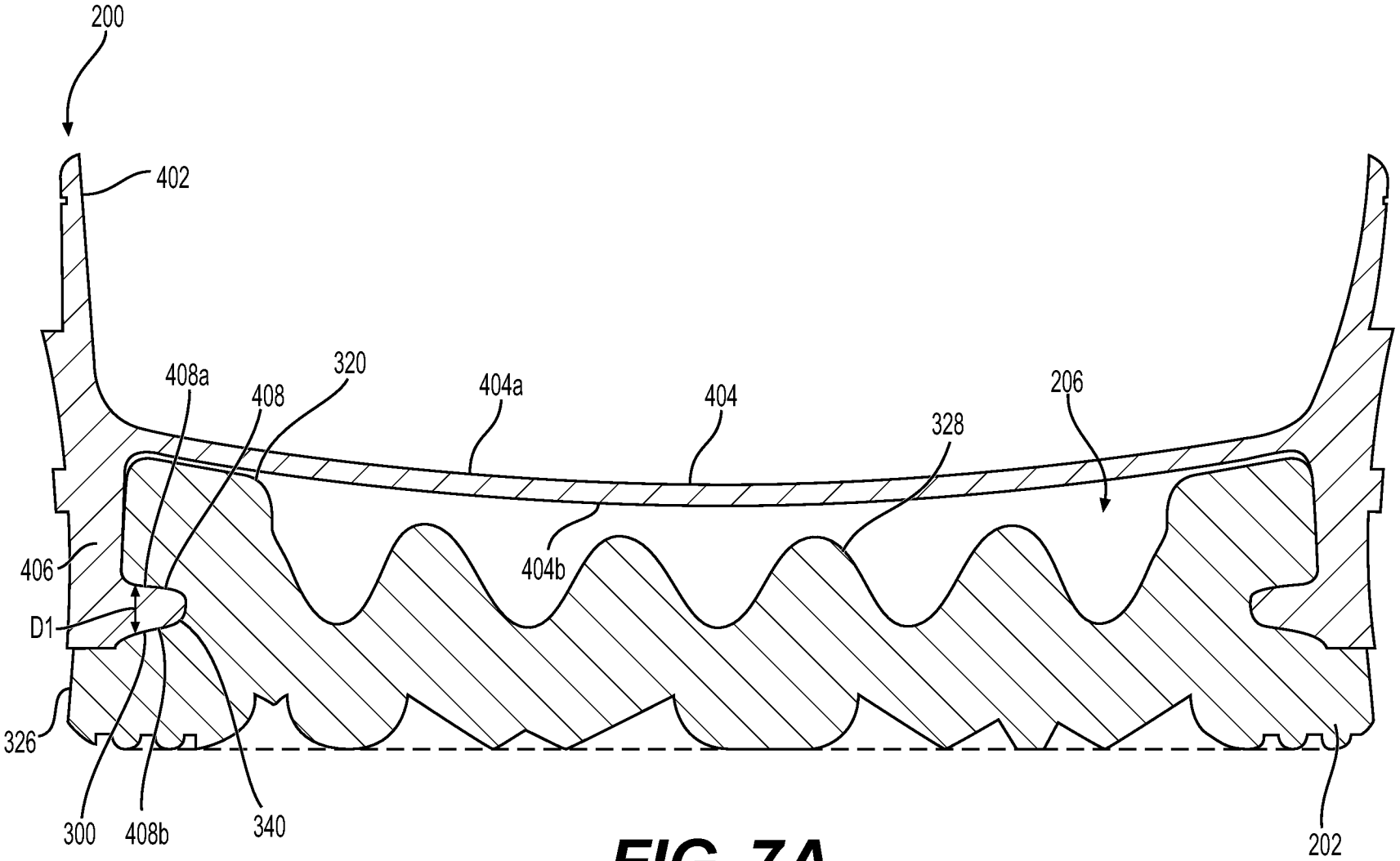
FIG. 7A is a cross-sectional view of the midsole coupled to the outsole of the article of footwear of FIG. 1 taken along line 7-7 of FIG. 1.

FIG. 7A depicts the midsole 200 and the outsole 202 in an assembled configuration. The recess 340 is configured to receive the rail 300 when the midsole 200 is coupled to the outsole 202. Specifically, the flange 408 of the rail 300 is disposed within the confines of the recess 340 of the outsole 202, such that the rail 300 extends through an entirety of the recess 340 and along a circumferential direction of the portion of the outsole 202 that includes the recess 340. The second portion 404*b* of the crossbar portion 404 is disposed adjacent to the top surface 320 of the outsole 202 when the outsole 202 is coupled to the midsole 200. In an example, the top surface 320 of the outsole 202 may not directly contact the midsole 200, such that a gap is formed between the top surface 320 and the crossbar portion 404. In other examples, the top surface 320 of the outsole 202 may directly contact the midsole 200, such that no gap is formed between the crossbar portion 404 and the top surface 320. In an example, the engagement feature(s) 328 may not directly contact the midsole 200, such that a gap is formed between the engagement feature(s) 328 and the crossbar portion 404. In other examples, the engagement feature(s) 328 may directly contact the midsole 200, such that no gap is formed between the engagement feature(s) 328 and the crossbar portion 404.

Figure 7B:
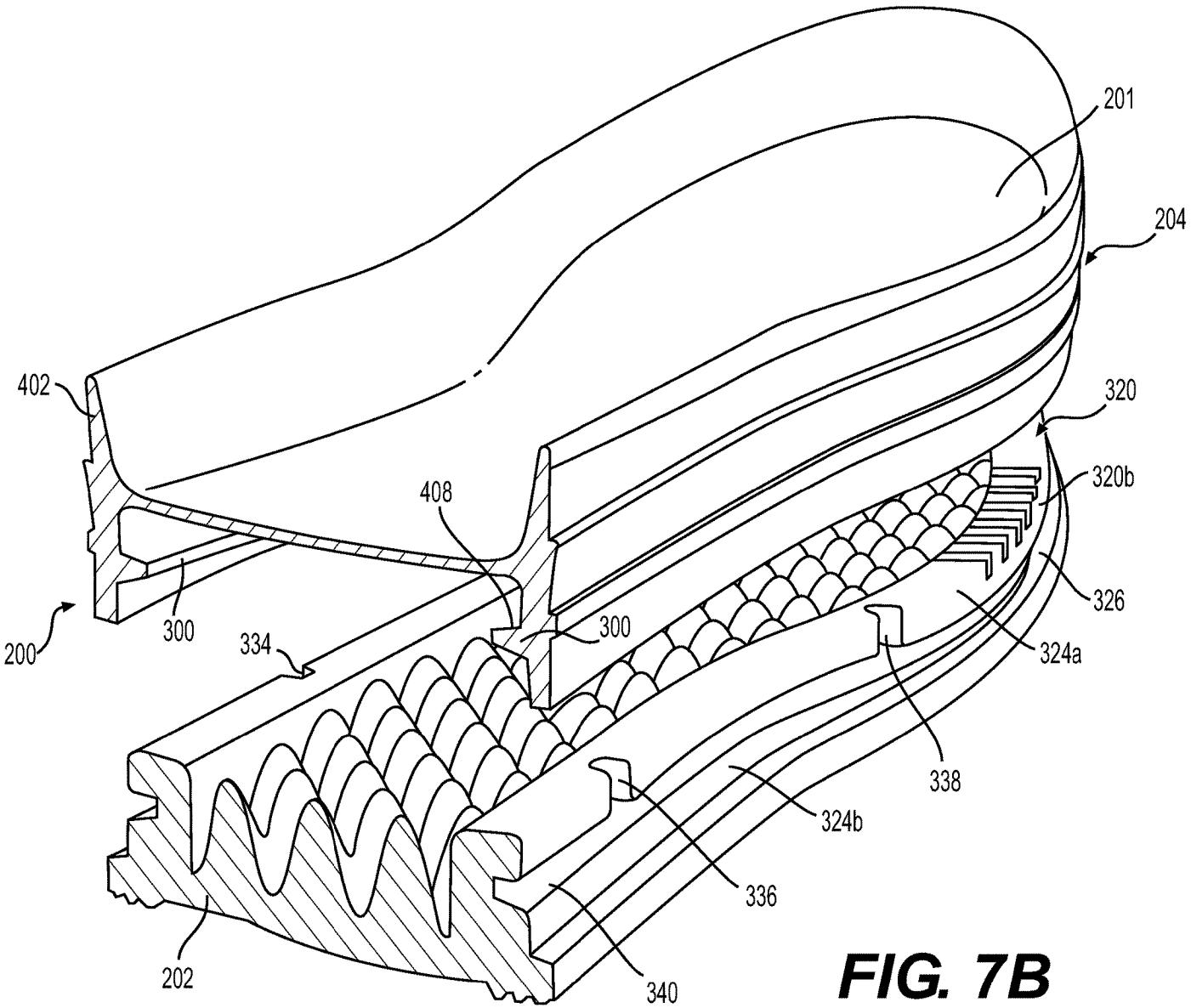
FIG. 7B is an exploded, partial cross-sectional view of the sole structure of the article of footwear of FIG. 1 taken along line 7-7 of FIG. 1.

Referring to FIG. 7B, the rail 300 interacts with the recess 340 and the vertical protrusions 420, 422 (FIG. 5B) interact with the vertical cuts 332, 334 (FIG. 3B) when the outsole 202 is coupled to the midsole 200. The vertical protrusions 420, 422 are each sized, shaped, and/or otherwise configured to extend into vertical cuts 332, 334, respectively, thereby coupling a portion of outsole 202 with midsole 200. The flange 408 of the rail 300 is received within the recess 340. The upward bias of the rail 300 relative to the outsole 202 is configured to at least partially inhibit the midsole 200 from decoupling from the outsole 202, such as during use of footwear 10. The flange 408 forms a flush connection with portions of the sidewall 324 forming the recess 340 of the outsole 202 when the rail 300 and the recess 340 are mated with one another (best shown in FIG. 7A.) The vertical protrusions 420, 422, 424, 426 are configured such that the protrusions 420, 422, 424, 426 are not received flush within the vertical cuts 332, 334, 336, 338 so as to allow for movement of the vertical protrusions 420, 422, 424, 426 relative to the vertical cuts 332, 334, 336, 338. Movement of the vertical protrusions 420, 422, 424, 426 relative to the vertical cuts 332, 334, 336, 338 may reduce horizontal shear forces imparted onto the sole structure 101, and particularly onto one or more of the midsole 200 and the outsole 202, such as in a longitudinal direction (e.g. parallel to the horizontal axis 6-6) during use of the footwear 10. It is contemplated that in other examples, vertical protrusions 420, 422, 424, 426 may form a flush connection with the vertical cuts 332, 334, 336, 338.

The outsole 202 is configured to be selectively decoupled from the midsole 200, such that the outsole 202 may be removed from the footwear 10 in response to an application of force (e.g., a pulling force) thereto. Removal of the outsole 202, such as for replacement and/or substitution, may done by a user pulling vertically downward (e.g., in a direction parallel to the vertical axis 8-8 of FIG. 1) on one or more components of the outsole 202. For example, the rand 204 may be configured and operable to be grasped by the user to separate the connection between the recess 340 of the outsole 202 and the rail 300 of the midsole 200, thereby decoupling the outsole 202 from the sole structure 101 of the footwear 10. To add a second outsole 202 to the sole structure 101 of the footwear 10, a portion of the (second) outsole 202, such as the top surface 320, is pushed into cavity 206 of the midsole 200 until the rail 300 is inserted into the recess 340. Stated differently, the outsole 202 may be pushed towards the midsole 200 (e.g., in a direction parallel to the vertical axis 8-8) and the recess 340 may receive the rail 300, thereby coupling the outsole 202 to the midsole 200. In this instance, the user may position (e.g., pull) the rand 204 around an exterior of the outsole 202 until the rail 300 is completely received within the recess 340.

The sole structure 101 as described above allows for the outsole 202 to be selectively removed and/or replaced within the footwear 10. Outsole 202 may be constructed using various techniques that allow for creation of desired features, such as firmness, density, impact attenuation, shape, configuration, size, contour, color, etc. The midsole 200 includes a first material that may include a rubber or other flexible material. The outsole 202 includes a second material that may be different from the first material, such as a foam, a rubber, or other durable material. In some examples, the first material may have a flexibility that is greater than the flexibility of the second material.

Other alternatives of the outsole 202 are envisioned. For example, the engagement feature 328 may include any other type of design suitable for providing a desired form of cushioning, traction, or engagement with the midsole 200. Additionally, one or more other surfaces of the outsole 202 may include various other designs, configurations, and/or arrangements without departing from a scope of this disclosure. As described above, the footwear 10 may be configured and operable to facilitate customization by providing a modular design in which one or more outsoles 202 may be selectively coupled and decoupled from the midsole 200. Accordingly, outsoles with varying aesthetic designs, structural configurations, or features, and/or material compositions may be assembled to the footwear 10 without the use of equipment, tools, or other ancillary devices. By providing such modular capabilities, a user of the footwear 10 may replace the outsole 202 for various purposes, such as due to extensive wear and tear, stylistic or aesthetic purposes, or functional characteristics.

Figure 8:
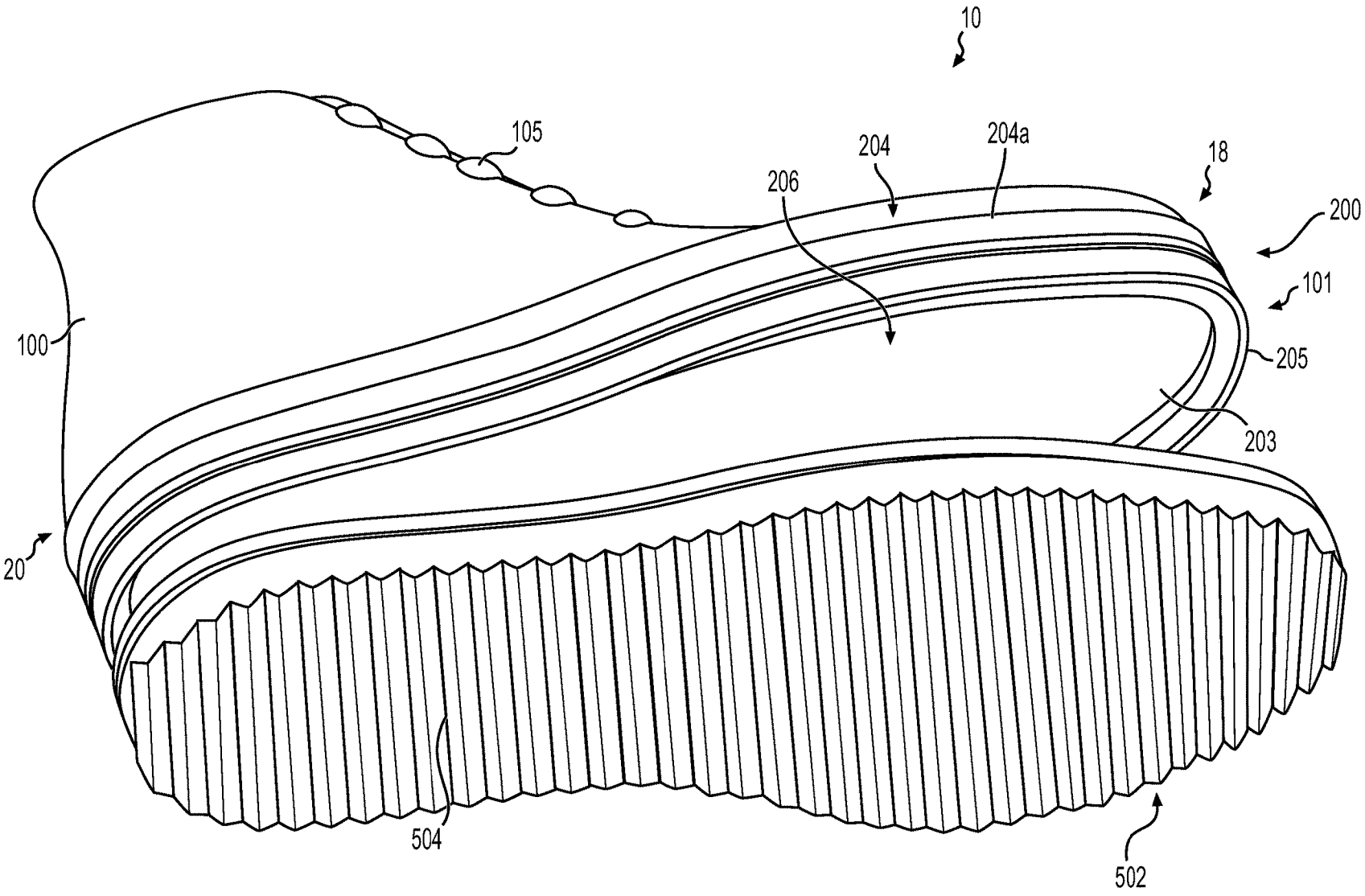
FIG. 8 is an exploded perspective view of an alternative article of footwear.
Figure 9:
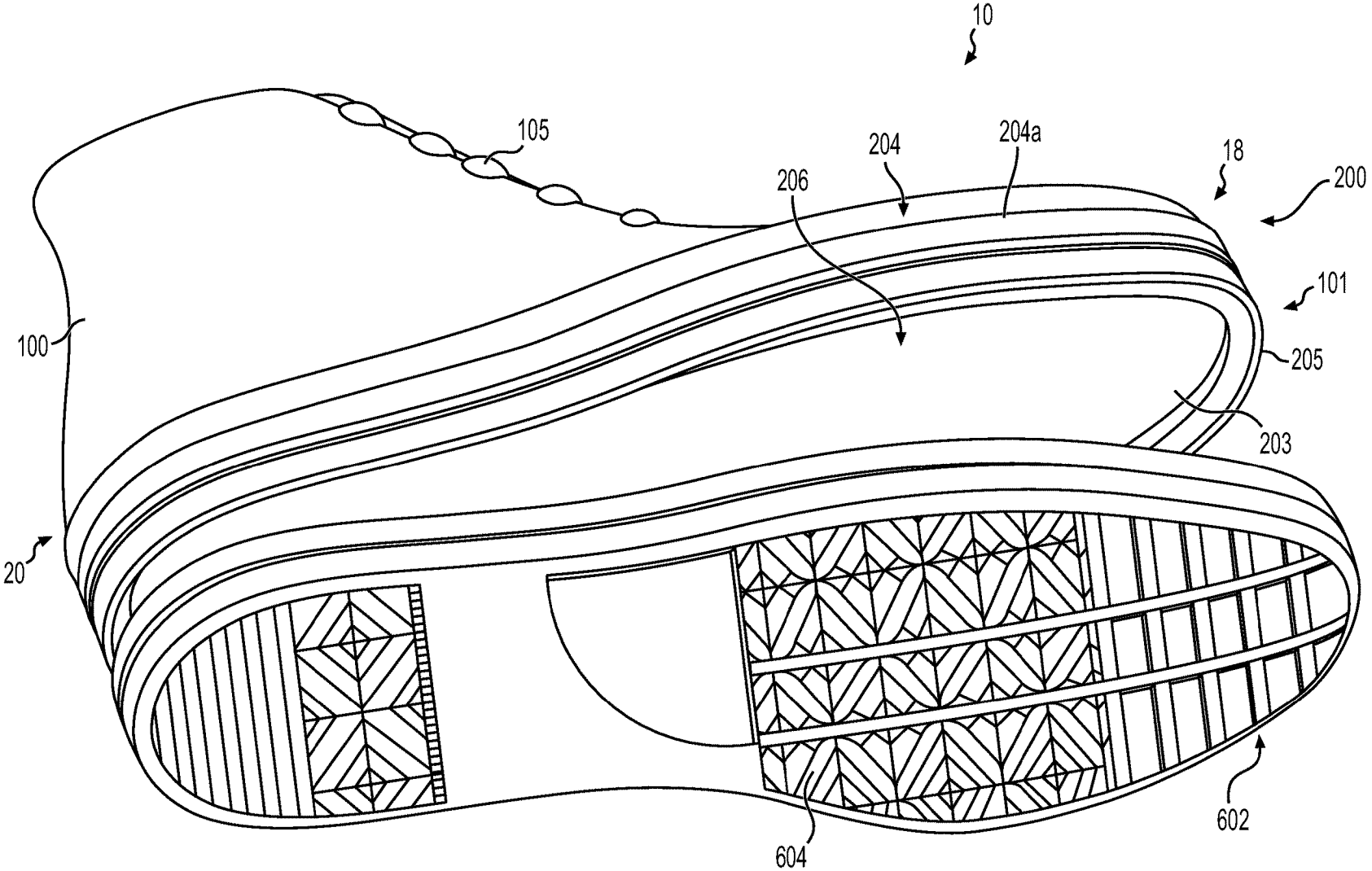
FIG. 9 is an exploded perspective view of an alternative article of footwear.

As shown in FIGS. 8-9, as an example, it should be appreciated that various outsoles with various suitable features and/or traction characteristics may be selected for use with the article of footwear 10. By way of a first example, FIG. 8 depicts an outsole 502 with first traction characteristics 504 in the form of a plurality of ridges extending across an exterior surface of the outsole 502. By way of another example, FIG. 9 depicts an outsole 602 with second traction characteristics 604 in the form of various line segments and polygonal shapes positioned across an exterior surface of the outsole 602.

Figure 10:
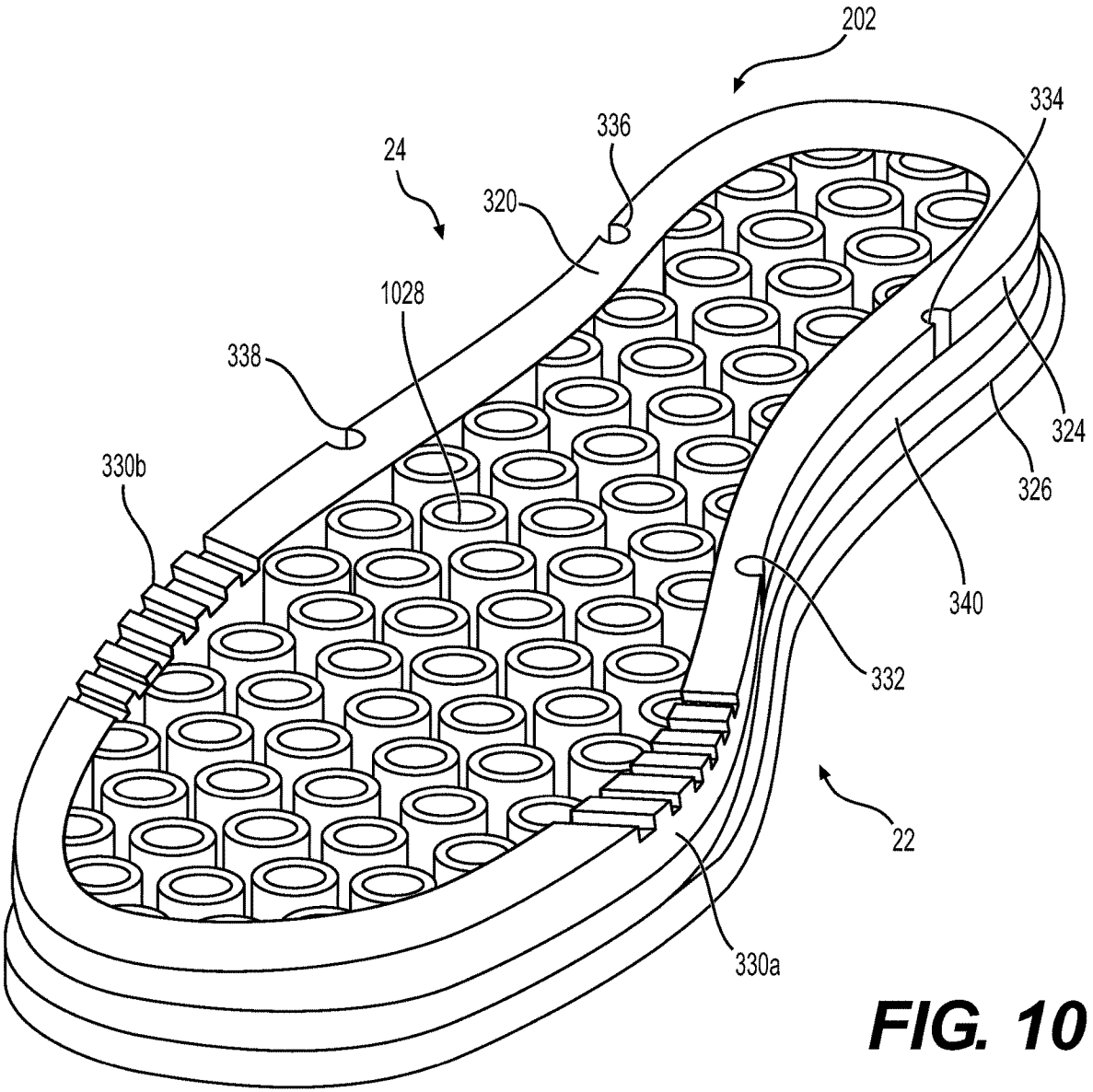
FIG. 10 is a perspective view of an alternative outsole.

FIG. 10 depicts an outsole 202 with alternative engagement feature(s) 1028. The alternative engagement feature(s) 1028 may be substantially tubular. The engagement feature (s) 1028 are used when the outsole 202 is comprised of a rubber, silicone, nitrile, neoprene, or the like. The alternative engagement feature(s) 1028 may provide a feeling of sensation, traction, or comfort to a user of the article of footwear 10 different than would be experienced by engagement feature(s) 328.

It is also contemplated that other alternative embodiments, instead of a single rail 300, the midsole 200 could include a plurality of rails 300 that may be spaced apart from another along the interior surface 204*b*, with each of the rails 300 including similar features as shown and described herein for coupling with the outsole 202. In other embodiments, one or more of the midsole 200 and/or the outsole 202 may include toothed features or mechanisms for assembling the sole structure 101 in lieu of the rail 300. In this instance, each of the midsole 200 and the outsole 202 may include complimentary toothed features that are configured to mesh and/or mate with one another, thereby coupling the midsole 200 and the outsole 202 to one another.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The following clauses provide an exemplary configuration for an article of footwear and sole structure described above.

Clause 1. A sole structure for an article of footwear comprising; a midsole having a support surface extending from a posterior end to an anterior end, the midsole having an outer surface and an inner surface, wherein the support surface and the inner surface surround a cavity, the midsole also including an inner rail extending along the inner surface and into the cavity; wherein the rail and the cavity are configured to engage with a removable outsole.

Clause 2. The sole structure of clause 1, further including the removable outsole that is received by the cavity and the inner rail.

Clause 3. The sole structure of clause 1 or 2, wherein the outer surface extends continuously in the circumferential direction.

Clause 4. The sole structure of any one of the previous clauses, wherein the inner rail extends continuously in the circumferential direction.

Clause 5. The sole structure of any one of the previous clauses, wherein, at the posterior end of the midsole, the inner surface extends above and below the inner rail.

Clause 6. The sole structure of any one of the previous clauses, wherein, at the anterior end of the midsole, the inner surface extends only above the inner rail, between the inner rail and the support surface.

Clause 7. The sole structure of any one of the previous clauses, wherein, at the posterior end of the midsole, the outer surface and the inner surface form a sidewall that is a lowest portion of the midsole, wherein the midsole further includes: a transition region disposed between the posterior end and the anterior end, wherein in the transition region, a height of the sidewall gradually decreases in the anterior direction until the inner rail becomes the lowest portion of the midsole disposed nearest a ground surface.

Clause 8. The sole structure of clause 7, wherein, at the anterior end of the midsole, the inner rail is the lowest portion of the midsole.

Clause 9. The sole structure of any one of the previous clauses, wherein the removable outsole includes a flange extending around a periphery of the removable outsole.

Clause 10. The sole structure of clause 9, wherein the removable outsole further includes a ground-contacting surface and a sidewall extending from the flange in a direction opposite of the ground contacting surface, and wherein a periphery of the ground-contacting surface is defined by a bottom of the flange.

Clause 11. The sole structure of clause 10, wherein the sidewall of the removable outsole includes an outer surface and a circumferential recess disposed into the outer surface, and wherein the circumferential recess is configured to receive the inner rail of the midsole when the midsole and the removable outsole are engaged.

Clause 12. The sole structure of clause 11, wherein the flange is configured to abut a bottom surface of the inner rail at the anterior end of the midsole.

Clause 13. The sole structure of clause 10, wherein the flange is configured to abut a bottom surface of the sidewall of the midsole at the posterior end of the midsole.

Clause 14. The sole structure of clause 11, wherein the circumferential recess slopes downward from a posterior end of the outsole toward an anterior end of the outsole, and wherein after sloping downward, the circumferential recess of the removable outsole slopes upward in the anterior direction.

Clause 15. The sole structure of clause 1, wherein the inner rail slopes downward from the posterior end of the midsole toward the anterior end of the midsole, and wherein the inner rail slopes upward in the anterior direction from a mid-foot region of the midsole to the anterior end of the midsole.

Clause 16. The sole structure of clause 1, wherein the midsole includes one or more of either protrusions or recesses disposed in a side surface extending vertically between the inner rail and the support surface.

Clause 17. The sole structure of clause 16, wherein the removable outsole includes one or more of the other of the recesses or protrusions disposed in the side surface extending vertically above the circumferential recess, wherein the one or more of the other of the recesses or protrusions of the removable outsole are configured to engage with the one or more of the either protrusions or recesses of the midsole when the midsole and removable outsole are engaged.

Clause 18. The sole structure of clause 1, wherein an uppermost surface of the removable outsole includes one or more slits configured to engage with a bottom of the inner rail.

Clause 19. The sole structure of clause 1, wherein the midsole includes a first material having a first durometer, and wherein the removable outsole includes a second material having a second durometer less than the first durometer.

Clause 20. An article of footwear including the sole structure of any of the preceding claims, the article of footwear further including an upper.

Clause 21. A removable outsole configured to engage with a midsole, wherein the removable outsole, comprises: a flange extending around a periphery of the removable outsole; a ground-contacting surface, wherein a periphery of the ground-contacting surface is defined by a bottom of the flange; a sidewall extending from the flange in a direction opposite of the ground contacting surface, wherein the sidewall includes an outer surface; a circumferential recess disposed within the outer surface; and one or more recesses or protrusions extending vertically in the outer surface of the sidewall.

We claim:

1. A sole structure for an article of footwear comprising;

a midsole having a support surface extending from a posterior end to an anterior end, the midsole having an outer surface and an inner surface, wherein the support surface and the inner surface surround a cavity, the midsole also including an inner rail extending along the inner surface and into the cavity;

wherein the inner rail and the cavity are configured to engage with a removable outsole, wherein, at the posterior end of the midsole, the outer surface and the inner surface form a sidewall that is a lowest portion of the midsole, wherein the midsole further includes:

a transition region disposed between the posterior end and the anterior end, wherein in the transition region, a height of the sidewall gradually decreases in an anterior direction until the inner rail becomes the lowest portion of the midsole disposed nearest a ground surface.

2. The sole structure of claim 1, further including the removable outsole that is received by the cavity and the inner rail.

3. The sole structure of claim 2, wherein the removable outsole includes a flange extending around a periphery of the removable outsole.

4. The sole structure of claim 3, wherein the removable outsole further includes a ground-contacting surface and a sidewall extending from the flange in a direction opposite of the ground-contacting surface, and wherein a periphery of the ground-contacting surface is defined by a bottom of the flange.

5. The sole structure of claim 4, wherein the sidewall of the removable outsole includes an outer surface and a circumferential recess disposed into the outer surface, and wherein the circumferential recess is configured to receive the inner rail of the midsole when the midsole and the removable outsole are engaged.

6. The sole structure of claim 4, wherein the flange is configured to abut a bottom surface of the inner rail at the anterior end of the midsole.

7. The sole structure of claim 4, wherein the flange is configured to abut a bottom surface of the sidewall of the midsole at the posterior end of the midsole.

8. The sole structure of claim 5, wherein the circumferential recess slopes downward from a posterior end of the removable outsole toward an anterior end of the removable outsole, and wherein after sloping downward, the circumferential recess of the removable outsole slopes upward in an anterior direction.

9. The sole structure of claim 1, wherein the outer surface extends continuously in a circumferential direction.

10. The sole structure of claim 1, wherein the inner rail extends continuously in a circumferential direction.

11. The sole structure of claim 1, wherein, at the posterior end of the midsole, the inner surface extends above and below the inner rail.

12. The sole structure of claim 1, wherein, at the anterior end of the midsole, the inner surface extends only above the inner rail, between the inner rail and the support surface.

13. The sole structure of claim 1, wherein, at the anterior end of the midsole, the inner rail is the lowest portion of the midsole.

14. A sole structure for an article of footwear comprising;

a midsole having a support surface extending from a posterior end to an anterior end, the midsole having an outer surface and an inner surface, wherein the support surface and the inner surface surround a cavity, the midsole also including an inner rail extending along the inner surface and into the cavity;

wherein the inner rail and the cavity are configured to engage with a removable outsole, wherein the inner rail slopes downward from the posterior end of the midsole toward the anterior end of the midsole, and wherein the inner rail slopes upward in an anterior direction from a mid-foot region of the midsole to the anterior end of the midsole.

15. The sole structure of claim 14, wherein the midsole includes one or more of either protrusions or recesses disposed in a side surface extending vertically between the inner rail and the support surface.

16. The sole structure of claim 15, further including the removable outsole that is received by the cavity and the inner rail, wherein the removable outsole includes one or more of the other of the recesses or protrusions wherein the one or more of the other of the recesses or protrusions of the removable outsole are configured to engage with the one or more of the either protrusions or recesses of the midsole when the midsole and removable outsole are engaged.

17. The sole structure of claim 14, wherein the midsole includes a first material having a first durometer, and wherein the removable outsole includes a second material having a second durometer less than the first durometer.

18. An article of footwear including the sole structure of claim 14, the article of footwear further including an upper.

19. The sole structure of claim 14, wherein at least one of:

at the posterior end of the midsole, the inner surface extends above and below the inner rail, or at the anterior end of the midsole, the inner surface extends only above the inner rail, between the inner rail and the support surface.

20. An article of footwear including the sole structure of claim 1, the article of footwear further including an upper.

* * * * *